United States Patent [19]

Darnell

[11] 3,998,417

[45] Dec. 21, 1976

[54] BACKING MEMBER

[75] Inventor: Arne P. Darnell, Urshult, Sweden

[73] Assignee: Perstorp AB, Perstorp, Sweden

[22] Filed: May 14, 1975

[21] Appl. No.: 577,458

[30] Foreign Application Priority Data

June 28, 1974 Sweden ..... 7408536

[52] U.S. Cl. ..... 248/222.2

[51] Int. Cl.[2] ..... A47F 5/00

[58] Field of Search ..... 248/223, 224, 225, 229, 248/205 A

[56] References Cited

UNITED STATES PATENTS

| | | | |
|---|---|---|---|
| 1,810,229 | 6/1931 | Stirrup | 248/223 |
| 3,175,031 | 3/1965 | Reiner | 248/223 |
| 3,388,884 | 6/1968 | Eggler et al. | 248/224 |
| 3,579,711 | 5/1971 | Nicolin | 248/223 |
| 3,695,568 | 10/1972 | Hogrebe | 248/223 |
| 3,809,799 | 5/1974 | Taylor | 248/223 |

FOREIGN PATENTS OR APPLICATIONS

| | | | |
|---|---|---|---|
| 124,944 | 10/1972 | Norway | 248/223 |

*Primary Examiner*—Robert A. Hafer

*Attorney, Agent, or Firm*—Stevens, Davis, Miller & Mosher

[57] ABSTRACT

Backing member of plastic intended to be fixed for example to a wall and to support a decorative wall plate, a shelf, a soap dish, a towel hanger etc., said backing member comprising a mainly square or rectangular plate or frame construction provided with a lock edge at the top, two lock springs at the bottom and one distance ear at each of the four corners, the lock edge and the lock springs being intended to engage with rails, extensions, pins etc. arranged at the inside of a decorative wall plate etc., which is provided with straight, right-angled sides, in such a way that the decorative plate can be firmly but yet dismountably secured to the backing member.

4 Claims, 3 Drawing Figures

BACKING MEMBER

Backing member

The present invention relates to a backing member of plastic intended to be fixed for example to a wall and to support a decorative wall plate, a shelf, a soap dish, a towel hanger etc. having straight, right-angled sides.

It is very difficult to fix products of the above-mentioned kind to a wall in a simple way so that an accurate fit is obtaind between the different units. It is especially complicated to bring about a fixing construction which at the same time makes it possible to obtain a simple dismounting and a firm anchorage of the decorative plate. According to the present invention the above-mentioned problems have been solved and a backing member of plastic intended to be fixed for example to a wall and to support a decorative wall plate, a shelf, a soap dish, a towel hanger etc. has been brought about. The backing member comprises a mainly square or rectangular plate or frame construction provided with a lock edge at the top, two lock springs at the bottom and one distance ear at each of the four corners. The lock edge and the lock springs are intended to engage with rails, extensions, pins etc. arranged at the inside of a decorative wall plate etc., which plate is provided with straight, right-angled sides. Thereby, the decorative plate can be firmly but yet dismountably secured to the backing member.

The lock edge along the upper side of the backing member can be divided into two or more parts. These must be dimensioned in such a way that they can support the whole weight of the decorative plate etc. However, to make it possible to dismount the decorative plate from the backing member, the outermost ends of the lock edge must be elastic.

The backing member according to the invention is intended to be fixed to the wall etc. by the help of a double-faced tape applied to the back of the backing member and/or by the help of screws or nails inserted through holes in the corners of the backing member.

The distance ears at the corners of the backing member have a very important function. Thus, at the mounting the backing member is placed in such a way that the distance ears lie close to a corner or a previously mounted plate for example. The distance ears are then broken, which can be brought about without any difficulty, whereupon the decorative wall plate if fixed by pressing against the backing member. Preferably, the distance ears are designed in such a way that the decorative plates will lie close together after the mounting. If desirable, there is of course a possibility to design the distance ears so that a certain distance is obtained between the decorative plates. In both cases the distance ears make it possible to bring about a rapid and exact mounting. If a double-faced tape is used for mounting of the backing member, it is necessary to place the backing member in the correct position at the first mounting attempt. Otherwise the mounting will be very costly.

The decorative plate etc. is preferably made of plastic and it is provided with a backwards directed edge along all its sides to give a hygienic and aesthetically attractive connection between the wall and the plate. In other words, the inside of the wall plate is bowl-shaped.

After the mounting, the backwards directed edges will lie close to the wall. This means that the lock edge and the lock springs of the backing member as well as the co-operating parts of the decorative plate cannot be reached from outside after the mounting. Therefore, the dismounting of the decorative plate should be very difficult. However, this is not the case, since also said problem has been solved in a smart way by the construction according to the invention.

Thus when one wants to dismount a decorative plate, one presses from above against the upper edge of the plate near one of the corners. Then the opposite corner situated below will be moved downwards and sideways. The lock spring of the backing member situated straight below the depressed corner is thereby disengaged. The other lock spring of the backing member can be disengaged in the same way by pressing near the other corner of the upper edge of the decorative plate. When both of the lock springs are disengaged, the decorative plate can be taken away, for instance to be replaced by another plate.

The simple dismounting technique gives a high flexibility concerning the composition of different plates on the wall. Consequently, the invention makes a whole fitting-up system available, where shelves, soap dishes, towel hangers etc. can be combined in an infinite number of ways with different decorative plates.

The invention will be explained further in connection with the enclosed Figures, of which FIG. 1 shows a perspective view of a backing member according to the invention.

Like numerals of reference indicate corresponding parts in the various Figures.

The backing member according to the invention comprises a mainly square or rectangular plate or frame construction 1 provided with a lock edge 2 at the top, two lock springs 3 at the bottom and one distance ear 4 at each of the four corners.

Figure 1:
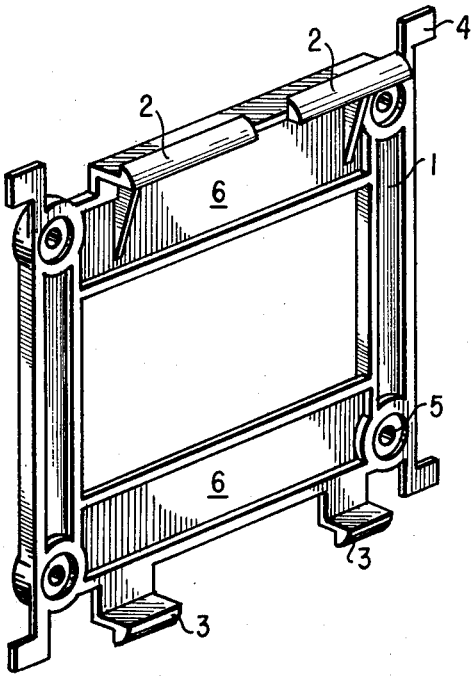

The backing member can be fixed for example to a wall by nails or screws inserted through holes 5 in the four corners of the backing member. It is, however, often more suitable to use a double-faced tape. At the embodiment of the backing member shown on FIG. 1 the tape is placed at the back of the surfaces 6.

Figure 2:
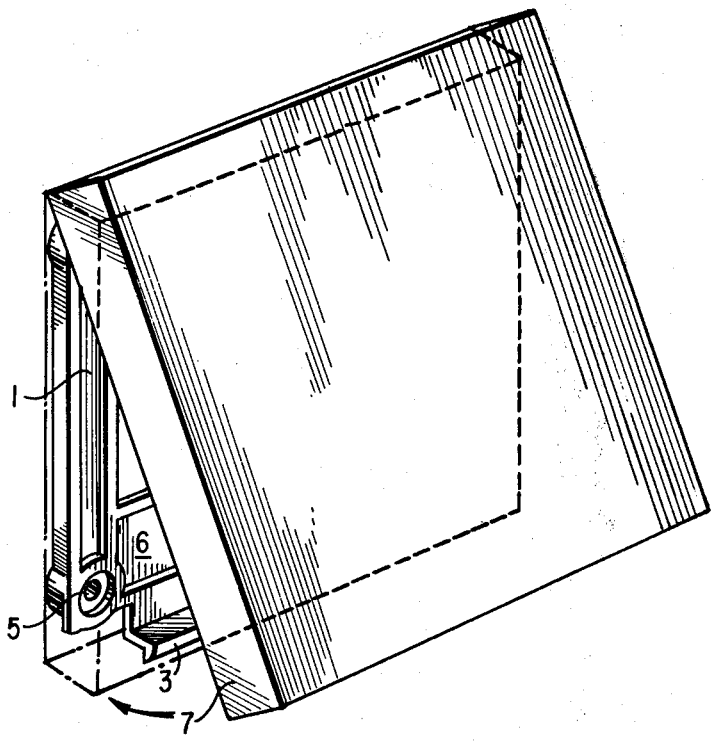
FIG. 2 shows a perspective view of a backing member fixed to a wall and a decorative plate, which is partly secured to the backing member.
Figure 3:
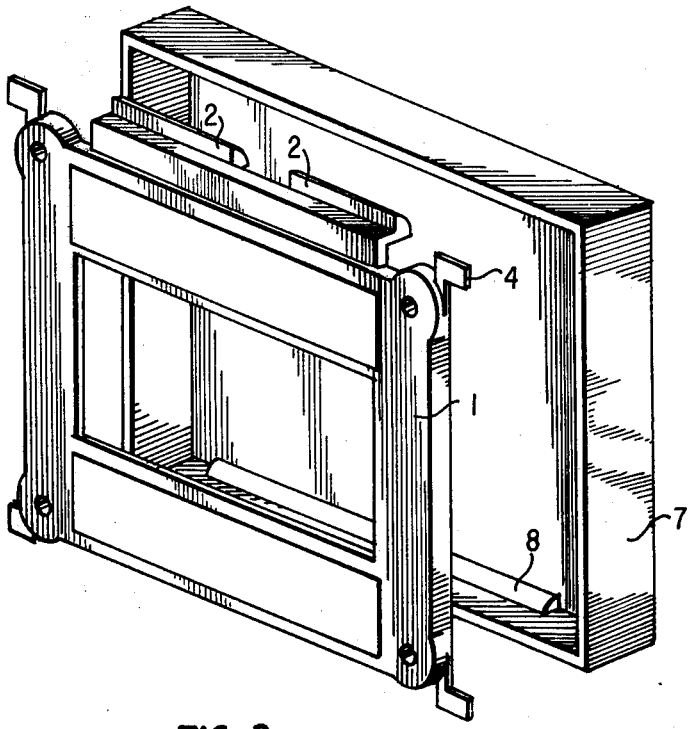
FIG. 3 shows a perspective view from behind of a backing member and a decorative plate.

FIG. 2 shows a backing member 1 fixed by double-faced tape to a wall. From the Figure it is evident that the distance ears 4 have been removed. A decorative wall plate 7 has been pushed downwards over the lock edge 2, so that a co-operating part (not shown) at the back of the decorative plate has engaged with the lock edge 2. The mounting of the decorative plate 7 can be completed by pushing the lower part of the plate in the direction of the arrow. Then the lock springs 3 engage with co-operating parts 8 (FIG. 3) at the back of the decorative plate.

While a particular embodiment of the invention has been shown, it will be understood, of course, that the invention is not limited thereto since many modifications may be made, and it is, therefore, contemplated to cover by the appended claims any such modifications as fall within the true spirit and scope of the invention.

I claim:

1. A backing member adapted to be fixed to a vertically extending supporting surface for supporting a mountable member, having substantially straight right-angled sides, thereon, said backing member being made of plastic and comprising a substantially rectangular plate having four corners, an outwardly and then upwardly directed lock edge at the top of the plate, two outwardly and then downwardly directed lock springs at the bottom of the plate and a breakable distance ear projecting from each of the four corners of the plate whereby the distance ears can be used to fix the position of the backing member and can thereafter be broken off, the lock edge and the lock springs being adapted to engage with at least one lock member on the straight, right-angled sides of the mountable member in such a way that it can be firmly yet dismountably secured to the backing member by pressing at least one lock member into engagement with at least one of the upwardly directed part of the lock edge and the downwardly directed part of the lock springs.

2. A backing member according to claim 1, characterized in that the lock edge is divided into at least two parts.

3. A backing member according to claim 1, characterized in that the outermost end of the lock edge is slightly elastic, whereby the mountable member can easily be dismounted from the backing member by pressing downward on the upper edge of the mountable member near one of its corners, so that one of the lock springs therebelow can be disengaged, the other one of said lock springs being disengaged in the same way, whereupon the mountable member can be moved away from the backing member.

4. A substantially vertically disposed backing member adapted to be fixed to a vertically extending supporting surface for supporting a rectangular mountable member having four substantially straight sides each of which is substantially perpendicular to the backing member, said backing member being made of plastic and comprising:

a substantially rectangular plate having four corners and having upper and lower edges which extend substantially horizontally;

a lock edge comprising:

a first substantially horizontally extending portion, one end of which is connected to the upper edge of the plate, projecting from the upper edge of the plate; and a second portion extending upwardly from the other end of the first portion;

a pair of lock springs spaced from each other along the lower edge of the plate, each of said lock springs comprising:

a first substantially horizontally extending part, one end of which is connected to the lower edge of the plate, projecting from the lower edge of the plate; and a second part extending downwardly from the other end of the first part;

said lock edge and said lock springs being engagable with respective lock members on the upper and lower sides of the mountable member so that it can be firmly secured to the backing member and yet dismountable therefrom by pressing a respective one of said lock members into engagement with its respective one of the second portion of the lock edge and the second part of the lock springs, and a breakable distance ear projecting from each of the four corners of the plate whereby the distance ears can be used to fix the position of the backing member and can thereafter be broken off.

* * * * *